United States Patent [19]

Hiyoshi et al.

[11] 4,253,367

[45] Mar. 3, 1981

[54] MUSICAL TONE FORMING DEVICE BY FM TECHNOLOGY

[75] Inventors: Teruo Hiyoshi; Akira Nakada; Shigeru Yamada, all of Hamamatsu, Japan

[73] Assignee: Nippon Gakki Seizo Kabushiki Kaisha, Hamamatsu, Japan

[21] Appl. No.: 81,541

[22] Filed: Oct. 3, 1979

[30] Foreign Application Priority Data

Oct. 6, 1978 [JP] Japan ..... 53-123774

[51] Int. Cl.[3] ..... G10H 1/08; G10H 5/00

[52] U.S. Cl. ..... 84/1.22; 84/1.24

[58] Field of Search ..... 84/1.01, 1.03, 1.22, 84/1.24, 1.25

[56] References Cited

U.S. PATENT DOCUMENTS

| | | | |
|---|---|---|---|
| 4,018,121 | 4/1977 | Chowning | 84/1.01 |
| 4,036,096 | 7/1977 | Tomisawa et al. | 84/1.01 |
| 4,082,027 | 4/1978 | Hiyoshi et al. | 84/1.01 |
| 4,103,582 | 8/1978 | Chibana | 84/1.24 |
| 4,112,803 | 9/1978 | Deutsch | 84/1.24 |
| 4,132,140 | 1/1979 | Chibana | 84/1.22 X |
| 4,133,242 | 1/1979 | Nagal et al. | 84/1.22 X |
| 4,135,422 | 1/1979 | Chibana | 84/1.01 |
| 4,138,915 | 2/1979 | Nagal et al. | 84/1.22 |
| 4,142,432 | 3/1979 | Kameyama et al. | 84/1.01 |
| 4,189,970 | 2/1980 | Woron | 84/1.24 X |

*Primary Examiner*—Stanley J. Witkowski

*Attorney, Agent, or Firm*—Spensley, Horn, Jubas & Lubitz

[57] ABSTRACT

A musical tone forming device comprises circuit system of digital calculation realizing frequency modulation technology in three different modes. In the first mode a plurality of frequency modulated waveforms are individually calculated in response to key depression and resultant data is added together to provide a musical tone signal, in the second mode, a signal waveform having a frequency corresponding to a depressed key is frequency-modulated with a plurality of signal waveforms, and in the third mode a signal waveform of a frequency corresponding to a depressed key is frequency-modulated in a multiple manner with a plurality of signal waveforms. Throughout these systems, the same component parts are commonly used and tone signals of the respective systems can be produced by a simple switching operation.

3 Claims, 1 Drawing Figure

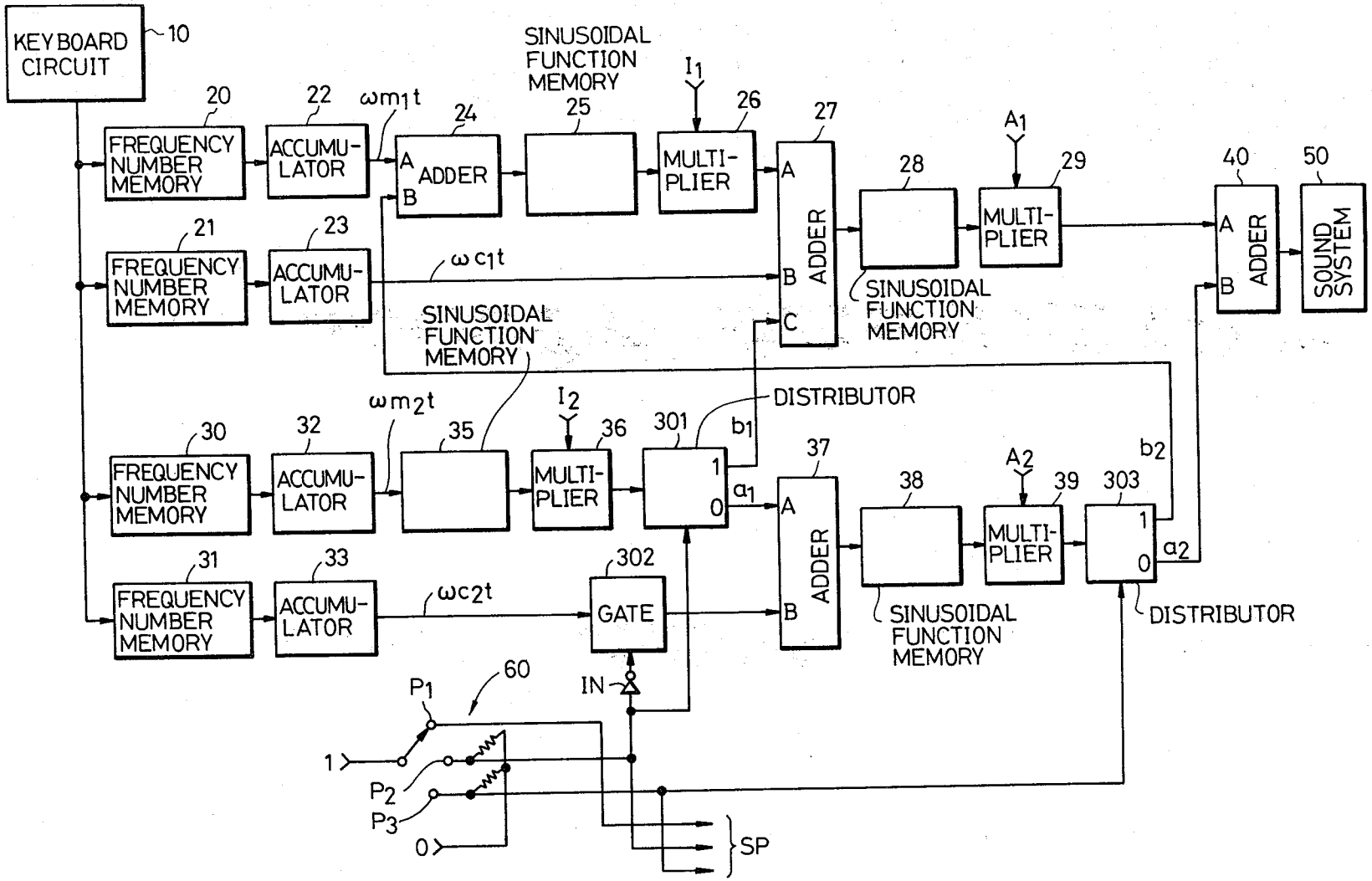
KEYBOARD CIRCUIT
10
FREQUENCY NUMBER MEMORY
20
21
30
31
ACCUMU-LATOR
22
23
32
33
ωm1t
ωc1t
ωm2t
ωc2t
ADDER
24
SINUSOIDAL FUNCTION MEMORY
25
MULTI-PLIER
26
I1
ADDER
27
A
B
C
SINUSOIDAL FUNCTION MEMORY
28
MULTI-PLIER
29
A1
ADDER
40
A
B
SOUND SYSTEM
50
SINUSOIDAL FUNCTION MEMORY
35
MULTI-PLIER
36
I2
DISTRIBUTOR
301
b1
a1
1
0
GATE
302
IN
DISTRIBUTOR
303
b2
a2
1
0
MULTI-PLIER
39
A2
SINUSOIDAL FUNCTION MEMORY
38
ADDER
37
A
B
SP
60
P1
P2
P3
1
0

MUSICAL TONE FORMING DEVICE BY FM TECHNOLOGY

BACKGROUND OF THE INVENTION

This invention relates to a musical tone forming device in an electronic musical instrument, which is simple in arrangement and is capable of forming a variety of musical tone signals, and more particularly to a device which utilizes a frequency modulation (FM) technologies to form musical tone signals.

A musical tone forming device according to the FM technology is described in the specification of U.S. Pat. No. 4,018,121. In order to provide richer musical tones with such a device utilizing the frequency modulation, it is preferable to employ various composition systems such as "a multi-series system", "a multi-term system" and "a multiple system".

In the "multi-series system", a plurality of frequency-modulated waveforms are separately (individually) calculated (obtained by calculation) in response to key depression, and the resultant respective waveform data are added together to provide a musical tone signal. One example of the calculation formula is as follows:

$$F = \sum_{i=1}^{n} A_i \cdot Z\{\omega_{ci}t + I_i \cdot G(\omega_{mi}t)\} \quad (1)$$

where $A_i$ (i=1, 2, . . . n) are the coefficients to determine the amplitudes of respective waveforms to be calculated, $I_i$ are the coefficients to determine the depths of the respective modulation, $\omega_{ci}$ and $\omega_{mi}$ are the angular velocities to determine the frequencies of the carrier waves and the modulating waves, respectively, and correspond to the tone pitch (frequency) of the depressed key, and Z and G are the predetermined mathematical functions such as sinusoidal functions (sin).

In the "multi-term system", a signal waveform having a frequency corresponding to the depressed key is frequency-modulated with a plurality of signal waveforms, to calculate (produce by calculation) a musical tone signal waveform. The calculation formula is as follows:

$$F = A_1 \cdot Z\{\omega_{c1}t + \sum_{i=1}^{n} I_i \cdot G(\omega_{mi}t)\} \quad (2)$$

where $A_1$, $\omega_{c1}$ and $\omega_{mi}$ are identical with those in the calculation formula (1).

In the "multiple system", the signal waveform of a frequency corresponding to a depressed key is frequency-modulated, in a multiple mode (multi-times), with a plurality of signal waveforms, to calculate a musical tone signal waveform. One example of a calculation formula which is employed in the case where, for instance, the signal waveform of a frequency corresponding to a depressed key is subjected to frequency modulation in a double mode, is as follows:

$$F = A_1 \cdot Z[\omega_{c1}t + I_1 \cdot G\{\omega_{m1}t + A_2 \cdot Z(\omega_{c2}t + I_2 \cdot G(\omega_{m2}t)\}] \quad (3)$$

where the values $A_1$, $A_2$, $I_1$, $I_2$, $\omega_{c1}$, $\omega_{c2}$, $\omega_{m1}$ and $\omega_{m2}$ are identical with those defined above.

Musical tone signals provided according to the above-described various composition systems are different in harmonic spectrum, and accordingly musical tones different in tone color can be formed. These systems have tone colors peculiar thereto. Accordingly, if the systems are switched according to a tone color selected or desired, produced musical tones can be desirably made richer. This may be achieved by a method in which musical tone generating devices according to the above-described various composition systems are juxtaposed and are selectively operated.

SUMMARY OF THE INVENTION

Accordingly, an object of this invention is to provide a musical tone forming device in an electronic musical instrument, which is simple in construction and can produce musical tone signals according to a plurality of composition systems, to form richer musical tones.

In developing the invention, attention has been paid to the common components in calculation circuits for carrying out the above-described various composition systems. That is, the various composition systems are so switched that the common components are commonly used. Thus, musical tone signals according to different composition systems are obtained by a simple switching operation.

In the "multi-series system," as described before, a plurality of values $E_i = A_i \cdot Z\{\omega_{ci}t + I_i \cdot G(\omega_{mi}t)\}$ where i=1, 2, . . . n are separately calculated, and the calculation results are added in an adder to provide an output waveform sample value at each sampling point. And if switching is effected so that values $I_2 \cdot G(\omega_{m2}t)$, $I_3 \cdot G(\omega_{m3}t)$, . . . and $I_n \cdot G(\omega_{mn}t)$ which are the intermediate calculation results of circuits adapted to calculate values $E_2$, $E_3$, . . . $E_n$ are added to a vlaue $I_1 \cdot G(\omega_{m1}t)$ which is the intermediate calculation result of a circuit adapted to calculate a value $E_1$, then the output waveform sample value according to the "multi-term system" is obtained from the output of the adder. Furthermore, if switching is so effected that the outputs of the circuits adapted to calculate values $E_2$, $E_3$, . . . $E_n$ are added to phase angle information $\omega_{m1}t$, $\omega_{m2}t$, . . . $\omega_{m(n-1)}t$ of the preceding circuits adapted to calculate values $E_1$, $E_2$, . . . $E_{n-1}$, the output waveform sample value according to the "multiple system" is obtained from the output of the adder.

BRIEF DESCRIPTION OF THE DRAWING

In the accompanying drawing, the single FIGURE is a block diagram showing one example of a musical tone forming device in an electronic musical instrument, according to this invention.

DETAILED DESCRIPTION OF THE INVENTION

One preferred embodiment of this invention will be described with reference to the single FIGURE in the accompanying drawing. In a musical tone forming device shown in the FIGURE, three kinds of musical tone signals according to "a two-series system", "a two-term system" and "a double system" are provided by simple switching means. The three systems are switched by a change-over switch 60.

First, the case where the armature of the switch 60 is tripped over to the contact $P_1$ will be described. In this case, control signals applied to distributors 301 and 303 are at a logical level "0" (hereinafter referred to merely as a "0" when applicable), and therefore the distributors 301 and 303 provide their input signals at the lower (as viewed in the drawing) output lines $a_1$ and $a_2$, respectively, A signal "1" (which is at a logical level "1")

obtained by an inverter IN is applied to a gate 302, and therefore the gate 302 is opened. As a result, a musical tone signal according to the two-series system is produced.

A keyboard circuit 10 provides key information representative of a depressed key. The key information is applied, as an address signal, to frequency number memories 20, 21, 30 and 31, each of which is formed of, for instance, a read-only memory (ROM) in which numerical value information (frequency numbers) corresponding to keys is stored at the respective addresses. Each frequency number memory outputs numerical value information corresponding to a depressed key in response to key information applied thereto. The numerical value information is applied to accumulators 22, 23, 32 and 33, and is accumulated in accordance with predetermined clock signals. Accordingly, the accumulators 22, 23, 32 and 33 output time function values $\omega_{m1}t$, $\omega_{c1}t$, $\omega_{m2}t$ and $\omega_{c2}t$ in correspondence to the frequency of the depressed key, respectively.

The value $\omega_{m1}t$ outputted by the accumulator 22 is applied to the input A of an adder 24, to the input B of which the signal on the upper output line $b_2$ of the distributor 303 is applied. Since the signal is at "0" in this case, the output value $\omega_{m1}t$ of the accumulator 22 is applied, as it is, through the adder 24 to a sinusoidal function memory 25. The sinusoidal function memory 25 comprises, for instance, a read-only-memory (ROM) which is addressed by the value $\omega_{m1}t$ and stores a sinusoidal function value $\sin \omega_{m1}t$. In response to the value $\omega_{m1}t$, the memory 25 read out a corresponding sinusoidal function value $\sin \omega_{m1}t$. The sinusoidal function value $\sin \omega_{m1}t$ is multiplied by a preset coefficient value $I_1$ in a multiplier 26, and the resultant value $I_1 \sin \omega_{m1}t$ is applied to the input A of an adder 27.

Applied respectively to the inputs B and C of the adder 27 are the value $\omega_{c1}t$ outputted by the accumulator 23 and the signal on the output line $b_1$ of the distributor 301. In this case, the output signal from the distributor 301 is at "0". Therefore, the adder 27 calculates a value $(\omega_{c1}t+I_1 \sin \omega_{m1}t)$ which is applied to a sinusoidal function memory 28. Being similar in arrangement to the above-described sinusoidal function memory 25, the sinusoidal function memory 28 receives the value $(\omega_{c1}t+I_1 \sin \omega_{m1}t)$ as an address signal to read out a value $\sin (\omega_{c1}t+I_1 \sin \omega_{m1}t)$. The value read out of the sinusoidal function memory 28 is multiplied by a preset coefficient value $A_1$ in a multiplier 29, and the resultant value is applied to the input A of an adder 40.

On the other hand, similarly as in the above-described case, the value $\omega_{m2}t$ outputted by the accumulator 32 is converted into a sinusoidal function value $\sin \omega_{m2}t$ by means of a sinusoidal function memory 35. The sinusoidal function value thus obtained is multiplied by a preset coefficient value $I_2$ in a multiplier 36, and the resultant value $I_2 \sin \omega_{m2}t$ is applied through the distributor 301 to the input A of an adder 37, where it is added to the output value $\omega_{c2}t$ of the accumulator 33 which is applied through the gate 302 to the input B of the adder. By this addition result value $(\omega_{c2}t+I_2 \sin \omega_{m2}t)$, a value $\sin (\omega_{c2}t+I_2 \sin \omega_{m2}t)$ is read out of a sinusoidal function memory 38. This value is multiplied by a preset coefficient value $A_2$ in a multiplier 39, and the resultant value $A_2 \sin (\omega_{c2}t+I_2 \sin \omega_{m2}t)$ is applied through the distributor 303 to the input B of the adder 40.

The adder 40 subjects the above-described two values applied thereto to addition, to output a value $A_1 \sin (\omega_{c1}t+I_1 \sin \omega_{m1}t)+A_2 \sin (\omega_{c2}t+I_2 \sin \omega_{m2}t)$.

The output values thus successively outputted by the adder 40 are the amplitude sample values of a musical tone signal according to the two-series system. The values are applied to a sound system where they are produced as a musical tone.

Next, the case where the armature of the change-over switch 60 is tripped over to the contact $P_2$ will be described. In this case, a signal "1" is applied to the distributor 301 and the distributor 301 provides its input signal at the upper output line $b_1$. As the signal "1" is inverted into a signal "0" by the inverter IN, the gate 302 is closed by the signal "0".

The output value $I_1 \sin \omega_{m1}t$ of the multiplier 26, the output value $\omega_{c1}t$ of the accumulator 23, and the output value $I_2 \sin \omega_{m2}t$ provided through the distributor 301 by the multiplier 36 are applied to the adder 27, where they are subjected to addition to provide a value $(\omega_{c1}t+I_1 \sin \omega_{m1}t+I_2 \sin \omega_{m2}t)$. The output of the adder 27 is applied, as an address signal, to the sinusoidal function memory 28, as a result of which the corresponding sinusoidal function value $\sin (\omega_{c1}t+I_1 \sin \omega_{m1}t+I_2 \sin \omega_{m2}t)$ is read out. The value thus read out is multiplied by the preset coefficient value $A_1$ in the multiplier 29, and the resultant value $A_1 \sin (\omega_{c1}t+I_1 \sin \omega_{m1}t+I_2 \sin \omega_{m2}t)$ is applied to the input A of the adder 40.

Since the distributor 301 has selected the upper output line $b_1$ and the gate 302 is maintained closed, the two inputs applied to the adder 37 are at "0", and therefore no signal is applied to the input B of the adder 40.

Accordingly, the output value $A_1 \sin (\omega_{c1}t+I_1 \sin \omega_{m1}t+I_2 \sin \omega_{m2}t)$ of the multiplier 29 is outputted, as it is, by the adder 40. This output value corresponds to the amplitude sample value of a musical tone signal according to the two-term system.

When the change-over switch 60 is operated to select the contact $P_3$, a signal "0" is applied to the distributor 301. In this case, the distributor 301 selects the lower output line $a_1$, and the signal "1" is applied to the gate 302 by means of the inverter IN; that is, the gate 302 is opened. On the other hand, the signal "1" is applied to the distributor 303, and the input signal is provided at the upper output line $b_2$ of the distributor 303.

As a result, the adder 24 receives the output value $\omega_{m1}t$ of the accumulator 22, and the output value $A_2 \sin (\omega_{c2}t+I_2 \sin \omega_{m2}t)$ of the multiplier 39 through the distributor 303. The adder 24 adds the two input values together to provide a value $\omega_{m1}t+A_2 \sin (\omega_{c2}t+I_2 \sin \omega_{m2}t)$. The output value of the adder 24 is applied, as an address signal, to the sinusoidal function memory 25 to read the corresponding sinusoidal function value $\sin \{\omega_{m1}t+A_2 \sin (\omega_{c2}t+I_2 \sin \omega_{m2}t)\}$. This value is multiplied by the preset coefficient value $I_1$ in the multiplier 26, and the resultant value $I_1 \sin \{\omega_{m1}t+A_2 \sin (\omega_{c2}t+I_2 \sin \omega_{m2}t)\}$ is applied to the adder 27. In the adder 27, this value is added to the output value $\omega_{c1}t$ of the accumulator 23 to provide a value $\omega_{c1}t+I_1 \sin \{\omega_{m1}t+A_2 \sin) \omega_{c2}t+I_2 \sin \omega_{m2}t)\}$ which is applied, as an address signal, to the sinusoidal function memory 28. In correspondence with this value, a sinusoidal function value $\sin [\omega_{c1}t+I_1 \sin \{\omega_{m1}t+A_2 \sin (\omega_{c2}t+I_2 \sin \omega_{m2}t)\}[$ is read out of the sinusoidal function memory 28. The value read out of the sinusoidal function memory 28 is multiplied by the preset value $A_1$ in the multiplier 29, and the resultant value $A_1 \sin [\omega_{c1}t+I_1 \sin \{\omega_{m1}t+A_2 \sin (\omega_{c2}t+I_2 \sin \omega_{m2}t)\}]$ is applied to the input A of the adder 40. The signal on the lower output line $a_2$ of the distributor 303 is applied to the input B of the adder 40; however, the signal is at "0".

Accordingly, the output value $A_1 \sin [\omega_{c1}t+I_1 \sin \{\omega_{m1}t+A_2 \sin (\omega_{c2}t+I_2 \sin \omega_{m2}t)\}]$ of the multiplier 29 is outputted, as it is, by the adder 40. This output corresponds to the amplitude sample value of a musical tone signal according to the dual double modulation system.

As is apparent from the above description, musical tone signals according to the three kinds of musical tone forming systems can be formed merely by operating the change-over switch 60. The circuitry can be obtained merely by adding the simple distributors and gates to the circuit of the multi-series system. Furthermore, as the circuitry commonly uses the main calculation circuits, the arrangement of the circuitry is relatively simple.

In the embodiment described above, the values $I_1$, $A_1$, $I_2$ and $A_2$ are preset in the multipliers 26, 29, 36 and 39, respectively; however, the values $I_1$, $A_1$, $I_2$ and $A_2$ may be switched in response to the output signal SP of the change-over switch 60. In addition, the values $\omega_{m1}$, $\omega_{c1}$, $\omega_{m2}$ and $\omega_{c2}$ may be switched in response to the signal SP.

One example of the musical tone forming device in which the two-series system, two-term system and double FM system are switched has been described. However, it can be readily understood from the above description that a musical tone forming device in which a multi-series system, a multi-term system and a multiple system are switched can be similarly provided.

What is claimed is:

1. Musical tone forming device in an electronic musical instrument comprising:

a plurality of musical tone forming circuits each including a phase angle information generation circuit generating first phase angle information $\omega_m t$ which progresses time-wisely and second phase angle information $\omega_c t$ which progresses time-wisely, a first waveform signal generation circuit generating a first waveform signal $G(\omega_m t)$ which is a function of said first phase angle information, an adder adding said first waveform signal $G(\omega_m t)$ and said second phase angle information $\omega_c t$ together and a second waveform signal generation circuit generating a second waveform signal $Z\{\omega_c t+G(\omega_m t)\}$ which is a function of the output of said adder which adder output constitutes third phase angle information;

a combination circuit for combining said second waveform signals outputted by the respective musical tone forming circuits; and a distribution circuit for preventing the output of a specific one of said musical tone forming circuits from being applied to said combination circuit and selectively operating to apply said first waveform signal generated in said specific musical tone forming circuit to said adder of another one of said musical tone forming circuits, two different musical tone signals being produced from the output of said combination circuit in accordance with the selection operation of said distribution circuit.

2. Musical tone forming device in an electronic musical instrument comprising:

a plurality of musical tone forming circuits each including a phase angle information generation circuit generating first phase angle information $\omega_m t$ which progresses time-wisely and second phase angle information $\omega_c t$ which progresses time-wisely, a first waveform signal generation circuit generating a first waveform signal $G(\omega_m t)$ which is a function of said first phase angle information, an adder adding said first waveform signal $G(\omega_m t)$ and said second phase angle information $\omega_c t$ together and a second waveform signal generation circuit generating a second waveform signal $Z\{\omega_c t+G(\omega_m t)\}$ which is a function of the output of said adder which adder output constitutes third phase angle information;

a combination circuit for combining said second waveform signals outputted by the respective musical tone forming circuits;

a distribution circuit selectively operating to apply the output of one of said musical tone forming circuits to said combination circuit or to add said output to said first phase angle information in another one of the musical tone forming circuits, two different musical tone signal being produced from the output of said combination circuit in accordance with the selective operation of said distribution circuit.

3. Musical tone forming device in an electronic musical instrument comprising:

a plurality of musical tone forming circuits each including a phase angle information generation circuit generating first phase angle information $\omega_m t$ which progresses time-wisely and second phase angle information $\omega_c t$ which progresses time-wisely, a first waveform signal generation circuit generating a first waveform signal $G(\omega_m t)$ which is a function of said first phase angle information, an adder adding said first waveform signal $G(\omega_m t)$ and said second phase angle information $\omega_c t$ together and a second waveform signal generation circuit generating a second waveform signal $Z\{\omega_c t+G(\omega_m t)\}$ which is a function of the output of said adder which adder output constitutes third phase angle information;

a combination circuit for combining said second waveform signals outputted by the respective musical tone forming circuits; and a distribution circuit selectively operating to (a) apply the output of one of said musical tone forming circuits to said combination circuit or (b) add said output to said first phase angle information in another one of said musical tone forming circuits or (c) prevent said output from being applied to said combination circuit and apply said first waveform signal generated in said specific musical tone forming circuit to said adder in another one of said musical tone forming circuits, three different musical tone signals being produced from the output of said combination circuit in accordance with the selective operation of said distribution circuit.

* * * * *